US005226214A

United States Patent [19]

Napolitano

[11] Patent Number: 5,226,214

[45] Date of Patent: Jul. 13, 1993

[54] DRUM CARDING MACHINE FOR MAKING NON WOVEN FABRICS AND NATURAL OR SYNTHETIC FIBER WEBS

[76] Inventor: Nicola Napolitano, Via Marincola, 3, 13100 - Biella (Vercelli), Italy

[21] Appl. No.: 905,550

[22] Filed: Jun. 25, 1992

[30] Foreign Application Priority Data

Jun. 28, 1991 [IT] Italy ..... MI91A-01790

[51] Int. Cl.[5] ..... D01G 15/00

[52] U.S. Cl. ..... 19/296; 19/98

[58] Field of Search ..... 19/296, 98, 302, 303, 19/99, 112

[56] References Cited

U.S. PATENT DOCUMENTS

| | | | |
|---|---|---|---|
| 3,550,214 | 12/1970 | Watanabe | 19/98 |
| 4,523,350 | 6/1985 | Schmiedgen et al. | 19/296 X |
| 4,697,311 | 10/1987 | Bernhardt et al. | 19/296 X |
| 4,843,685 | 7/1989 | Vesa et al. | 19/296 X |
| 4,852,217 | 8/1989 | Bernhardt et al. | 19/98 |
| 4,858,276 | 8/1989 | Frosch et al. | 19/98 |
| 4,958,404 | 9/1990 | Lasenga | 19/98 |

*Primary Examiner*—Clifford D. Crowder
*Assistant Examiner*—John J. Calvert
*Attorney, Agent, or Firm*—Bucknam and Archer

[57] ABSTRACT

In a carding machine for making non woven fiber laps and natural or synthetic fiber webs there are provided either a single carding unit or multiple carding units, each carding unit including a first carding drum and a conveyor cylinder cooperating with the first carding drum, as well as a second carding drum. Between the first and second carding drums there are arranged, after the conveyor cylinder, two or more combing cylinders for conveying the half-finished fiber web to the second carding drum. Each combing cylinder, supplied by a single conveyor cylinder, is followed by a distributor cylinder cooperating with a further cylinder for removing the carded webs or laps. As the carding machine includes multiple carding units, each drum is followed by a conveyor cylinder supplying two or more combing cylinders, the carding drum also including several operating assemblies for evenly spreading the fibers on the drums.

5 Claims, 3 Drawing Sheets

DRUM CARDING MACHINE FOR MAKING NON WOVEN FABRICS AND NATURAL OR SYNTHETIC FIBER WEBS

BACKGROUND OF THE INVENTION

The present invention relates to a carding machine including either a single carding unit or a plurality of carding units, in particular for making non woven fiber laps or fabrics (which are also called non-wovens), and open-end laps or articles.

A carding machine of the above mentioned type usually comprises one or more carding units, and each carding unit includes at least a first, a second and also a third region: the first region is provided for supplying and roughing the fiber material, the second region, called carding unit proper which can be a multiple unit in carding machines having several assemblies, being provided for refining the processed material so as to evenly spread the fibers and discharge them on one or more combing cylinders, the third region being provided for forming the carded laps and removing the latter from the end cylinders of the machine.

In particular, the present invention relates to a carding machine including fixed and movable carding drums and cylinders or flats, as well as combing cylinders, with at least a first supplying region, an intermediate processing region and a discharging or output region, which operate as follows:

the first supplying region comprises a unit for supplying the natural or synthetic fibers in a staple condition, for subjecting the staple fibers to an opening step before supplying the fibers to the subsequent region;

the second intermediate processing region comprises a first carding drum and processing cylinders as well as turning cylinders and/or fixed or movable carding caps arranged on the periphery of the drum to separate, unravel, orient and card the fibers by means of a carding step proper; this region further comprising a conveyor cylinder which turns with a turning speed which is 25–80% greater than the speed of the carding drum, followed by two combing cylinders, the second region including a plurality of like regions in the carding machine having several carding units;

the third region comprises condensing members and/or discharging members including web or lap removing cylinders or combs which are supplied by output combing means.

The web from the first carding drum is removed by means of the conveyor cylinder which has a double function of:

a) a conveyor cylinder, since it has a turning rate of 25–80% greater than the rate of the carding drum, and being provided with a carding clothing including teeth adapted to entrain and remove all of the fibers supplied by the first carding drum;

b) a discharging cylinder or drum which discharges the fibers loaded thereon in part on a first combing unit and in part on a second combing unit.

The fiber material which is present on the two combing units is directly discharged on the second carding drum of the mentioned carding machine, since the speed of this second drum is much greater than that of the two combing units.

The rotary direction of the two combing units can be either clockwise or anti-clockwise.

For removing the fiber material from the conveyor cylinder it is possible to use two or more combing units.

By these combing units or cylinders, there is obtained a carded fiber web having two layers on the second drum of the carding assembly.

The main advantages of the carding machine of the present invention are hereinbelow listed:

1) The fiber material is fully removed or discharged from the first carding drum;

2) A better mixing of the fibers carded by the first drum before discharging said fibers on the second carding drum, owing to the provision of a plurality of turning and processing cylinders;

3) A facilitated discharging operation from the conveyor cylinder since the latter has a less diameter and a greater speed than the first drum;

4) The carding drum can rotate with a peripheral speed less than the speed of prior carding drums, without impairing the fiber discharging operation while reducing or fully eliminating the fiber wirls on the surface of the first carding drum, as well as possible meltings of thermoplastic fibers;

5) On the first carding drum it is possible to use carding clothings with sharper angles so as to greatly increase the carding power of the machine, since the discharging from the first drum is independent from the combing units and is set by the conveyor unit arranged after the first drum; this it is possible to omit the prior art combing and conveyor cylinders so as to greatly simplify the construction of the carding machine;

6) A better exploitation of the surface of the first carding drum is possible, since it is possible to recover a space on its periphery and thus add a greater number of operating and turning cylinders or other carding members, so as to greatly improve the distribution of the fibers on the drum. This solution can be applied, as discovered by the Applicant, both in the first carding assembly or unit and in the end carding unit of any carding machine.

Moreover, if the invention as disclosed is applied to the end carding unit or assembly, it allows to use a single distributor cylinder for each combing cylinder, whereas there are at present necessary two distributor cylinders in order to obtain two separated and condensed laps.

A main feature of the invention, accordingly, is the provision of a conveyor cylinder and two or more combing cylinders arranged between the two drums of each carding unit or assembly, which allows to reduce the required space on the periphery of the main drum and accordingly to add several working and turning cylinders or other fixed or movable carding members on the drum, thereby improving the laying of the fibers and increasing the yield of the machine both from a qualitative and a quantitative standpoint, since the lap produced by the carding machine comprises two layers having a homogeneity and resistance greater than those of a lap or web consisting of a single layer, the specific weight of the fiber structure being the same. The possibility of superimposing two separated layers by using two combing units allows to obtain a lap or web of greater specific weight.

Accordingly, the main object of the invention is to improve the yield and quality of the lap or web produced by the carding machine, as well as to simplify its construction which, as stated, is at present very complex.

According to the invention, this object is achieved owing to the fact that the above mentioned means for removing the fiber lap or web from the carding drum comprise a conveyor cylinder followed by two intermediate combing cylinders for forming two parallel laps, which cylinders operate to deposit a two-layer lap on the second carding drum. This feature allows to enhance the advantages deriving from the provision of two or more output combing cylinders, since the provision of a conveyor cylinder connected to two intermediate combing cylinders allows the second drum to be supplied with a greater amount of fibers, thereby improving the carding machine yield and providing an improved product quality with respect to the homogeneity and strength of the obtained lap or web.

Preferably, the first drum is coated by a carding clothing having teeth which have a slope greater than that of conventional carding teeth, and with the tips of the teeth facing the rotary direction of the drum, which coincides with that of the fiber material advancement.

The conveyor cylinder is coated by a carding clothing in which the tips of the clothing teeth face, as stated, the rotary direction.

The two intermediate combing units or assemblies are suitably coated by carding clothings having teeth forming an angle greater than that of the teeth of the drum and with tips facing a direction adapted to retain the fibers supplied by the conveyor.

Moreover, the conveyor cylinder and the two combing cylinders are provided with carding clothings including teeth forming different angles and having a different density and they may also have different peripheral speeds; moreover, the turning direction of the combing units or assemblies can be any and it does not affect the yield. The conveyor cylinder is provided with carding clothings including teeth the tips of which face the advancement direction of the fiber materials so as to remove the fiber product from the main drum by means of a drawing effect due to the speed greater than that of the carding main drum, which provides a less strong construction, and reduces the inertial effects of the drum, with a consequent less requirement on the starting power.

Then, the two combing cylinders transfer the lap or web formed by the conveyor cylinder to the second drum of the end region, thereby holding the characteristics of said lap constant.

BRIEF DESCRIPTION OF THE DRAWINGS

The invention will be disclosed in a more detailed way hereinafter with respect to a not limitative embodiment thereof, with reference to the accompanying drawings, where.

DESCRIPTION OF THE PREFERRED EMBODIMENT

Figure 1:
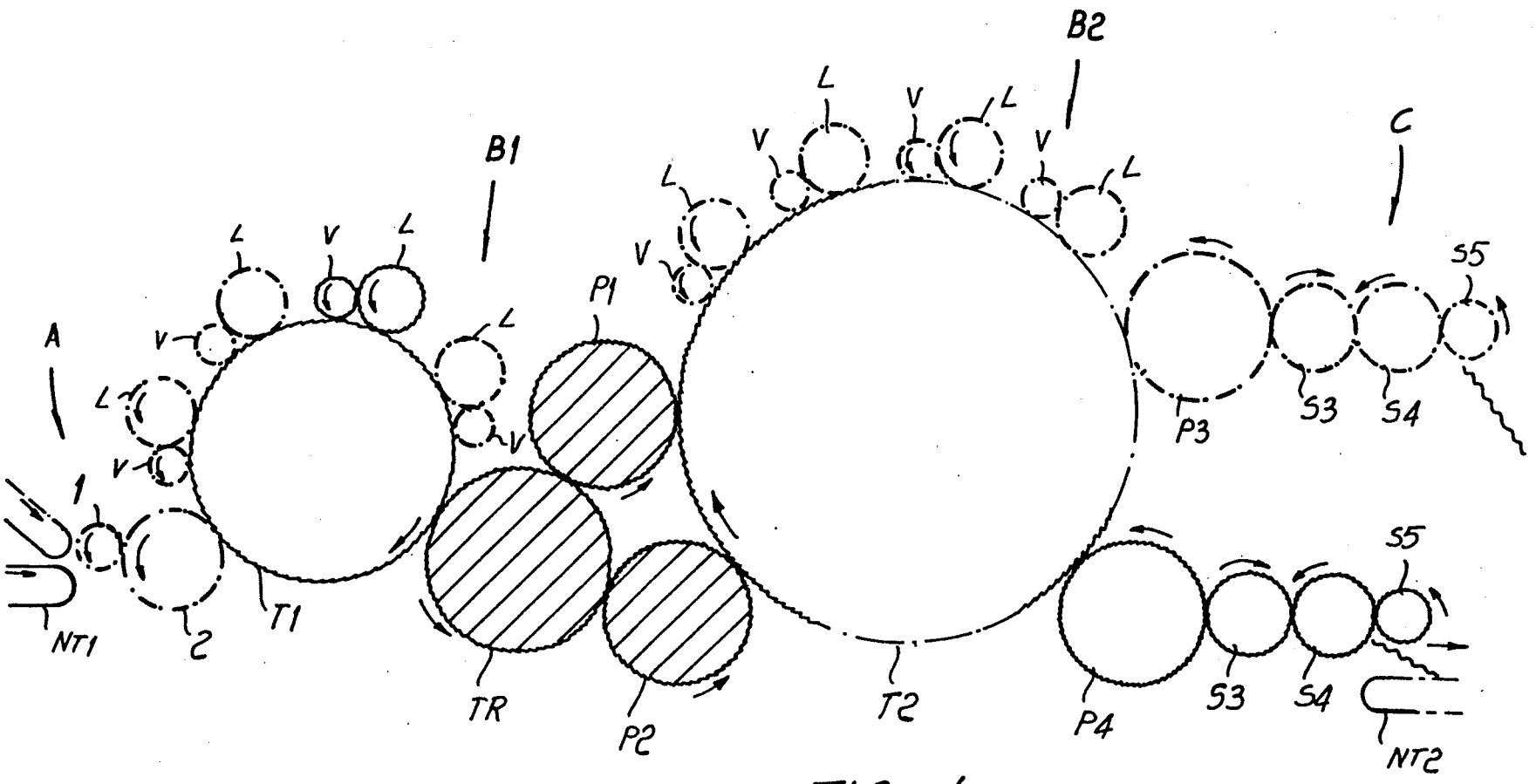
FIG. 1 is a schematic diagram illustrating a carding machine including a double carding assembly of the first carding machine stage, including drums and cylinders according to the invention, the second stage being shown as a conventional system.

As shown in FIG. 1, the carding machine comprises a first region, generally indicated at A, two second regions indicated at B1 and B2, and third region generally indicated at C.

The region A comprises a continuous belt supplying conveyor NT1 for supplying staple fibers to inlet members including the cylinders 1 and 2, the cylinder 1 being provided with a tray member for collecting the fibers in order to allow the latter to be engaged by the cylinder 1. The cylinder 2 is a loader which transfers the fibers from the cylinder 1 to the carding drum T1 of the region B1.

The region B1, as shown, comprises a cylinder-drum T1, and on the periphey of the drum T1 there are provided several operating or working cylinders L as well as several associated turning cylinders V. The rotary directions of the cylinders L, V and drum T1 are indicated by arrows. Preferably, the drum T1 is coated by a toothed carding clothing the teeth of which have a slope that is greater than that of conventional carding teeth, so as to improve the carding power of the machine, the subject teeth having their tips facing the turning or rotary direction, which coincides with that of the fiber material advancement.

The region B further comprises a conveyor cylinder TR cooperating with two inner combing cylinders or units P1, P2. The removal of the fiber material from the drum T1 is performed exclusively by the cylinder conveyor TR which turns with a speed which is of 25–80% greater than that of the drum T1. Said conveyor cylinder TR contacts the two combing cylinders P1 and P2 which are coated by carding clothings including teeth with a high angular value, and the rotary direction of which is unimportant. In this connection it should be pointed out that the two intermediate combing cylinders P1, P2 can be coated by carding clothings having either like or different tooth angle and density values, and they can also have either like or different peripheral speeds. The two cylinders P1 and P2 operate as transfer members for transferring the fiber material from the region A to the region C, and the tips of the teeth of their carding clothings face the rotary direction indicated by the arrows and have a peripheral speed which is less than that of the intermediate conveyor cylinder TR. The material removal effect of the conveyor cylinder TR on the drum T1 is a drawing effect, whereas between the conveyor cylinder TR and combing cylinders P1, P2 this removal is obtained by a condensation of the fibers.

As shown, the region B2 comprises a second carding unit or assembly including a drum T2 and two output combing cylinders P3, P4 which turn in the direction indicated by the respective arrows.

The region C comprises the discharging zone of the combing cylinders P3, P4: in the embodiment being disclosed it comprises for each combing cylinder a double condensing cylinder S3, S4 and a related unloading assembly including the cylinder S5 and a conveyor belt NT2 conveying the lap to the subsequent carding machine.

As stated, the regions A, B1, B2, C form a two carding drum carding machine, in which the section A is provided for supplying and roughing the fiber material, the section or region B1 for performing a first carding operation on the fibers and for the conveyance thereof, the region or section B2 for refining the openings between the fibers and forming evenly carded laps, and, finally, the region of section C operates to unload and discharge the lap or web.

The disclosed carding machine operates as follows:

The two intermediate combing cylinders P1 and P2 condense on their surfaces the fibers supplied by the drum T1 through the conveyor cylinder TR, so as to form two separated laps. The two laps formed on P1 and P2 are directly sent to the second drum T2 of the region B2. The latter is thus supplied with a greater material amount, so as to improve the yield and the quality of the lap with respect to prior carding methods.

In fact, by removing the fiber material from the drum T1 by the conveyor cylinder TR and the two intermediate combing cylinders P1 and P2, the drum T2 can be perfectly supplied with fibers, since the supplied fibers are separated on two different paths. Thus, it is possible to provide, just in the first section of the carding machine, a lap of great homogeneity, even by starting from staple fibers of very different characteristics, that is having different quality, density and length. On the other hand, the greater yield which can be obtained by using a conveyor cylinder TR and two intermediate combing cylinders P1, P2 allows to use carding clothings including teeth with a smaller pitch, and accordingly provided with a greater carding power just in the region B1, so as to further improve the quality of the obtained product.

The provision of the two intermediate combing cylinders P1, P2 allows either like or different peripheral speeds and either like or different rotary directions so as to allow the fibers to be indifferently arranged on the surfaces of the combing cylinders, thereby improving the eveness of the laps.

These advantages add to those obtained owing to the provision of an outlet conveyor cylinder, and, because of this feature, the carding machine according to the present invention, greatly improves the end product.

Figure 2:
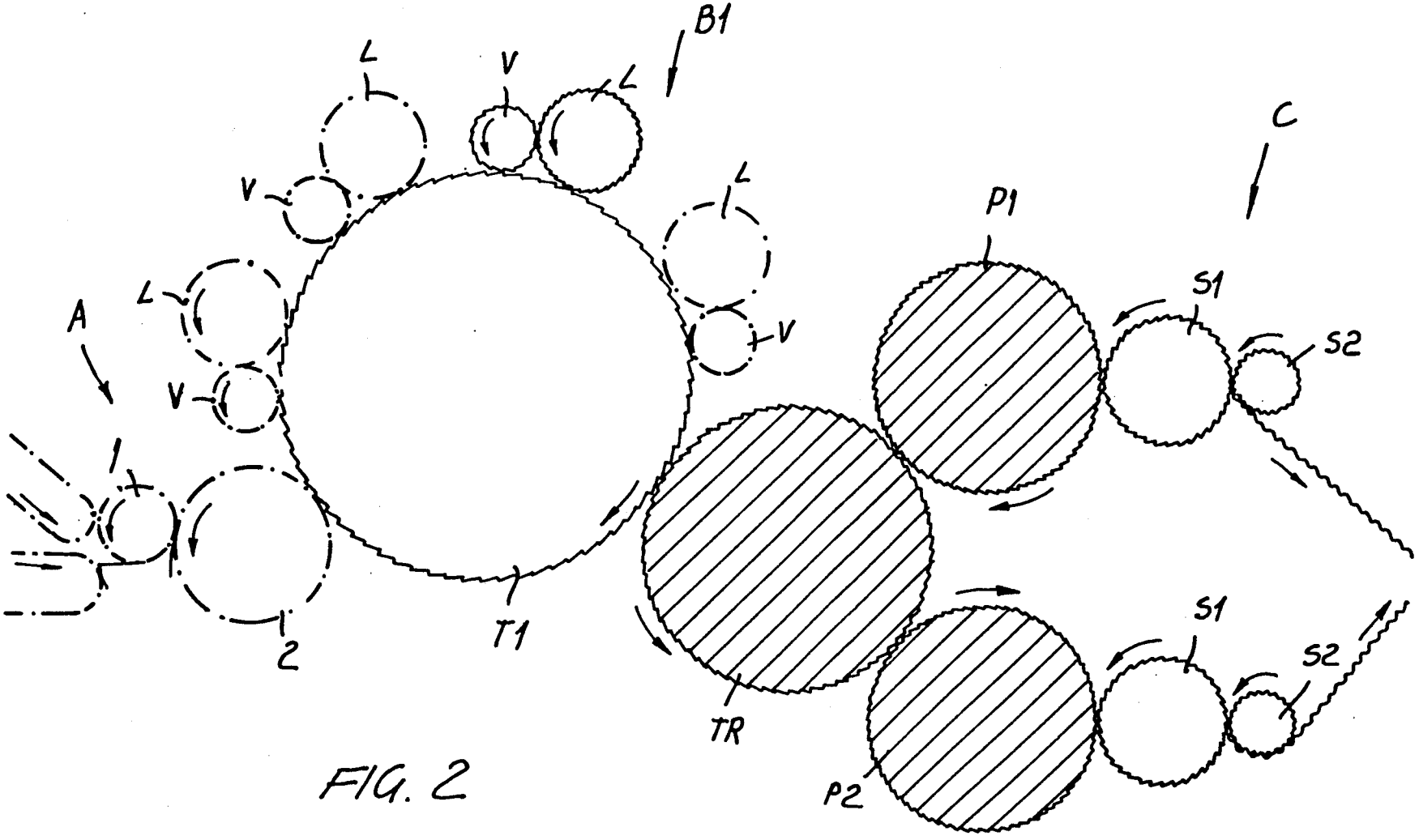
FIG. 2 illustrates an end stage according to the invention of the single carding unit carding machine.

FIG. 2 illustrates an end stage of the carding machine which, after each combing cylinder P1, P2, comprises a distributor cylinder S1 for each combing cylinder P1 and P2, each of said cylinders S1 being followed by a second removing cylinder S2 which detach the lap, the two separated laps being then sent to an end compression assembly.

Figure 3:
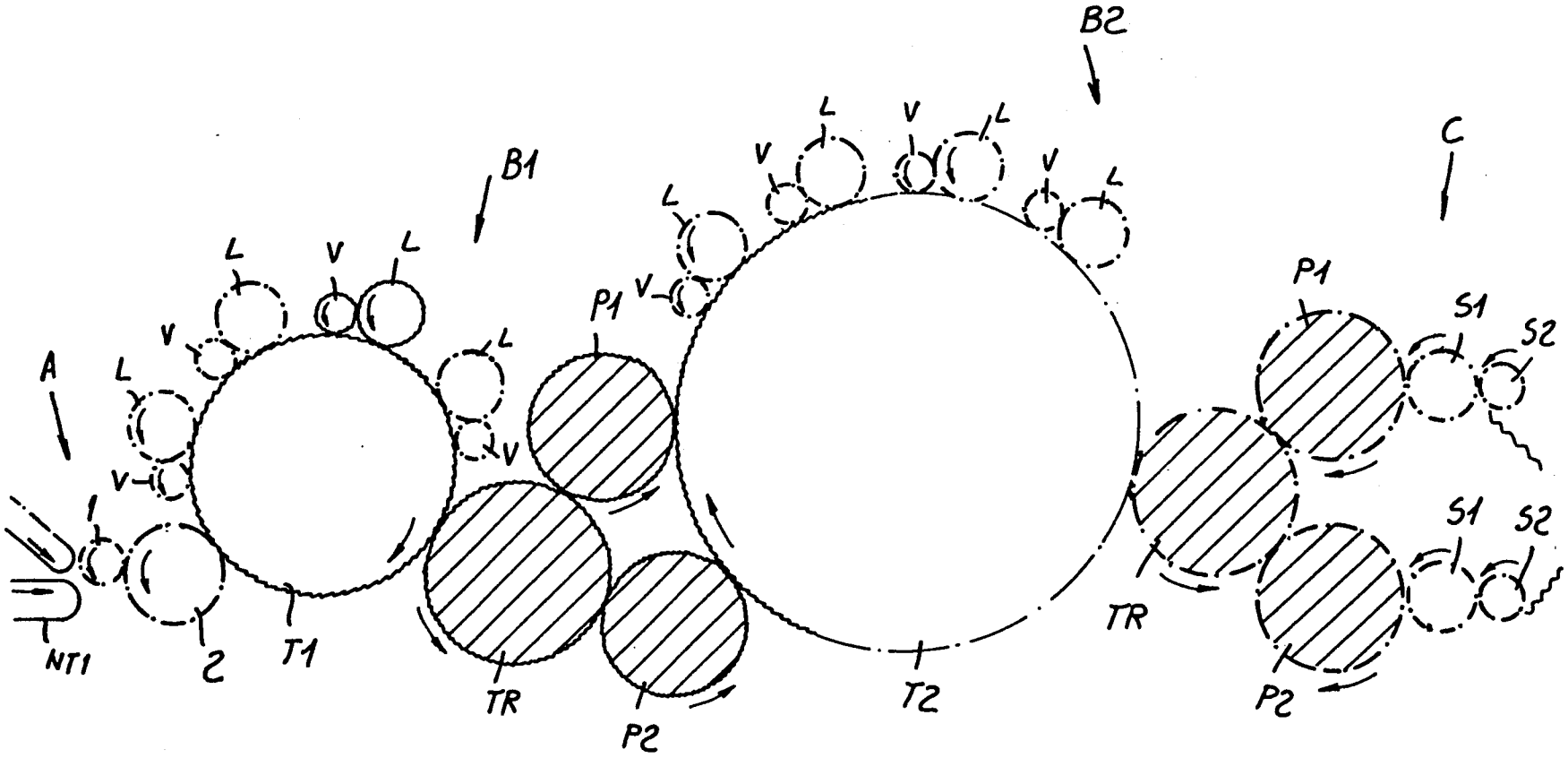
FIG. 3 illustrates a double carding unit carding machine, in which the two carding units are made according to the invention.

FIG. 3 illustrates the two carding assemblies, in which each drum is followed by a conveyor cylinder TR supplying two combing cylinders P1, P2; moreover, each combing cylinder P1 and P2 of the end region C includes a distributor cylinder S1 followed by the unloading cylinder S2.

While the invention has been disclosed and illustrated with reference to a preferred embodiment thereof, it should be apparent that the disclosed embodiment is susceptible to several modifications and variations all of which will come within the spirit and scope of the appended claims.

I claim:

1. A cylinder carding machine, for making nonwoven webs and laps, half-combed fiber webs and open end fiber webs, said carding machine comprising sequentially:

a first fiber supply region comprising a conveyor belt and two loading cylinders for supplying fibers to be carded, in staple form, to a first carding drum;

a second region comprising said first carding drum and processing and turning cylinders arranged peripherally of said first carding drum;

said second region further comprising a conveyor cylinder having a rotary speed which is of 25–80% greater than a rotary speed of said first carding drum, and two combing and discharging cylinders cooperating with said conveyor cylinder;

a third region comprising a second carding drum fiber supplied by said conveyor cylinder and said two combing and discharging cylinders, a plurality of processing and turning cylinders being arranged peripherally of said second drum, in a like way as that of said first carding drum, and at least a further combing cylinder arranged at the outlet of said second carding drum, and cooperating with said second carding drum;

a fourth region comprising discharging cylinder elements supplied by said second carding drum;

said conveyor cylinder being covered by a clothing having teeth which are oriented in a rotary direction of said conveyor cylinder, and cooperate with said first carding drum with a rotary speed of 25–80% greater and having a rotary direction opposite to a rotary direction of said carding drum for entraining fibers supplied by said first carding drum and for discharging said fibers in part on one of said two combing and discharging cylinders and in part on the other of said two combing and discharging cylinders.

2. A machine according to claim 1, wherein said conveyor cylinder discharging said first carding drum has a diameter less that and a peripheral speed greater than that of said first carding drum.

3. A machine, according to claim 1, wherein said combing and discharging cylinders are covered by clothings having teeth including tooth apex directed in a same or opposite direction with respect to a rotary direction of said combing and discharging cylinders, said conveyor cylinder having a clothing with teeth which are directed in a rotary direction of said conveyor cylinder in order to cause fibers conveyed by said conveyor cylinder to be condensed.

4. A machine, according to claim 1, wherein, in said first region, for each said combing cylinder there is provided a single condensing cylinder followed by further unloading means for unloading two discrete fiber laps from said condensing cylinder.

5. A machine, according to claim 1, wherein said two combing and discharging cylinders of said second region directly cooperate with said second carding drum.

* * * * *